US005289830A

United States Patent [19]

Levine

[11] Patent Number: 5,289,830

[45] Date of Patent: Mar. 1, 1994

[54] RAISED RIDGE KNEE PAD

[76] Inventor: Norman D. Levine, P.O. Box 1867, Pompano Beach, Fla. 33061

[21] Appl. No.: 810,671

[22] Filed: Dec. 19, 1991

[51] Int. Cl.[5] ..... A61F 13/00

[52] U.S. Cl. ..... 128/882; 128/846

[58] Field of Search ..... 128/846, 882, 892, 878, 128/879, 880, 881, DIG. 15; 2/22, 24; 602/23, 26

[56] References Cited

U.S. PATENT DOCUMENTS

| | | | |
|---|---|---|---|
| 1,158,208 | 10/1915 | Hart | 2/22 |
| 2,818,571 | 1/1958 | Grant | 2/22 |
| 2,982,968 | 5/1961 | Groot | 2/22 |
| 3,135,964 | 6/1964 | Pender | 2/22 |
| 3,735,419 | 5/1973 | Byrd | 2/22 |
| 3,772,704 | 11/1973 | Carbonneau | 2/22 |
| 4,068,312 | 1/1978 | Ledesma | 2/24 |
| 4,888,826 | 12/1989 | Parsons, Jr. et al. | 2/22 |
| 5,005,565 | 4/1991 | Fratesi | 2/22 X |
| 5,062,433 | 11/1991 | Kummer | 128/846 X |

FOREIGN PATENT DOCUMENTS

| | | | |
|---|---|---|---|
| 541894 | 12/1941 | United Kingdom | 2/22 |

*Primary Examiner*—Robert A. Hafer
*Assistant Examiner*—Sam Rimell
*Attorney, Agent, or Firm*—Malin, Haley, DiMaggi & Crosby

[57] ABSTRACT

This invention is concerned with a protective knee guard which is useful for protecting a skateboard rider's knee areas from injury while affording the rider additional control of the skateboard. The knee guard has a protective shell having integral raised ridge areas which define a control surface, permitting the rider to make sliding contact between the knee guard and the ground in a manner to achieve superior board control during various stunts such as precision control in landings subsequent to ramp assisted aerial maneuvers.

10 Claims, 4 Drawing Sheets

RAISED RIDGE KNEE PAD

BACKGROUND OF THE INVENTION

1. Field of the Invention

This invention relates generally to protective gear for skateboard riders, and more particularly to a knee pad for insulating the knee areas from injury while affording the rider additional control of the board by providing a protective shell having integral raised ridge areas which define a control surface which may be brought into sliding contact with the riding surface.

2. Description of the Prior Art

Skateboarding has flourished into a popular sport in recent years and enjoys active participation by a large number of today's youth. Serious riders compete in national and international freestyle competitions where they often perform dangerous stunts as they leap off of a swimming pool wall or half pipe into the air. Present skateboards are constructed from lightweight advanced composite materials and employ high-tech wheels and bearings in the quest for ever higher levels of performance. Unfortunately, the number of serious injuries to the knee, elbow, and head areas sustained during falls while riding skateboards is an undeniable reality. Various manufacturers have brought a myriad of protective devices to the marketplace which reduce the likelihood of serious injuries sustained while riding skateboards. With particular reference to the knee area, such protective devices typically comprise a resilient pad Which is strapped firmly around the rider's legs. The pad usually has a rigid outer surface for absorbing direct impact with the riding medium, and is backed by a cushioning material to dissipate and distribute shock loads away from critical areas of the knee which are highly susceptible to injury. However, there appears to be no such protective pad currently available, which in addition to its protective function, permits the rider to make sliding contact between the pad and the ground in a manner to achieve superior board control during various stunts such as precision controlled landings subsequent to ramp assisted aerial maneuvers.

Therefore, there exists a need for a knee pad which protects the rider against dangerous knee injuries, and which provides the rider with a new dimension of board control.

SUMMARY OF THE INVENTION

The present invention provides a knee pad to be worn by a skateboard rider which reduces the likelihood of serious knee injuries and additionally affords the rider an added means of control during complex maneuvering such as precision controlled landings after ramp assisted takeoffs. The knee pad comprises a rigid shell member which is secured to a padded body portion which is capable of being releasably attached to the rider's leg.

The rigid shell member is preferably fabricated from injection molded or vacuum formed plastic. It is defined by a convex outer surface which is of compound curvature having integrally molded raised ridges extending outward therefrom and blending therewith. In the preferred embodiment, there are two opposing side ridges which define a channel therebetween and a central ridge disposed within the channel. The side ridges have flat sides which intersect the compound curvature to form a smooth blending of the surfaces, and which terminate in a flat top portion. This flat top portion provides a uniform confronting surface which may be brought into sliding contact with the riding surface to assist the rider in the execution of complex maneuvers. By varying the knee angle of incidence relative to the riding surface, differing amounts of friction loads are generated which act as a variable brake. It is significant that the raised ridge tops form a flat confronting surface which aids the rider's balance when brought into engagement with the riding surface. If a shell having a uniformed curved outer surface is brought into sliding contact with the riding surface, very little support is realized since a much smaller area of contact occurs when a curved surface slides against a substantially flat surface. Furthermore, the raised ridge areas impart substantial structural rigidity to the shell member by acting as "hat sections" which reduce any tendency the shell member might have to buckle under high impact loads. The central ridge is located midway between the opposing side ridges and extends outwardly from the convex outer surface to function solely as a stiffener for the middle portion of the shell surface.

The rigid shell member is securely attached to a padded body portion by either fasteners or adhesive. The body portion is made of wearable material defining a first side having the rigid shell member attached thereto, and second side attached to the first side defining a hollow cavity therebetween and terminating along four elongated side edges. In the preferred embodiment, the first side is fabricated from a durable suede material and is either bonded or stitched to the second side which is constructed from terry cloth. The terry cloth side will provide a soft surface against the rider's leg when the pad is being worn.

Within the hollow cavity between the sides is disposed a plurality of cushioning members which may be made from a resilient material such as low density foam. The foam may be installed as an individual piece which is machined to size, or in several pieces as required to facilitate manufacture. The foam is elastic and thus dissipates the impact loads incurred during a fall to reduce the likelihood of injurious shock to the knee area.

The pad is firmly secured to each of the rider's legs by a plurality of flaps and straps connected to two opposing elongated side edges on the body portion along fold lines by either adhesive or stitching. The flaps and straps have hook and loop fastener areas attached thereto on opposing faces such that they may be releasably secured when wrapped around the rider's leg.

In accordance with the present invention, it is an object thereof to provide a knee pad to be worn by a skateboard rider to shield the knee areas from serious injury.

It is another object of the instant invention to provide a knee pad to be worn by a skateboard rider which may assist the rider in complex riding maneuvers by employing a novel integrated sliding surface in a rigid shell member.

In accordance with these and other objects which will be apparent hereinafter, the instant invention will now become be described with particular reference to the accompanying drawings.

DETAILED DESCRIPTION OF THE PREFERRED EMBODIMENT

Figure 2:
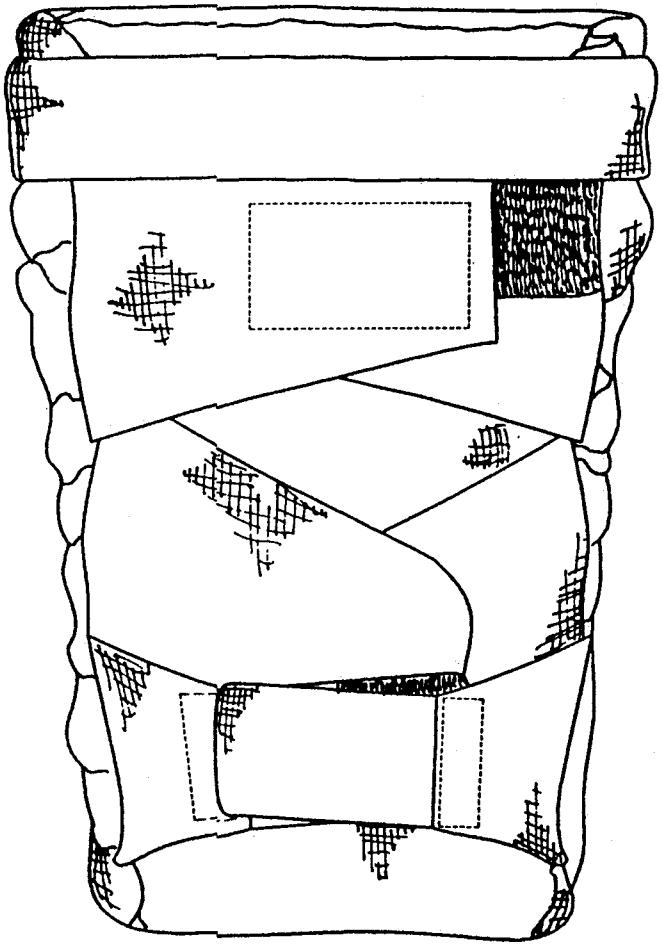
FIG. 2 is a bottom isometric view of the pad assembly.

With reference to the several views of the drawing, there is depicted a raised ridge protective pad assembly generally characterized by reference numeral 10 comprising rigid shell member 12 and body portion 14.

Figure 4:
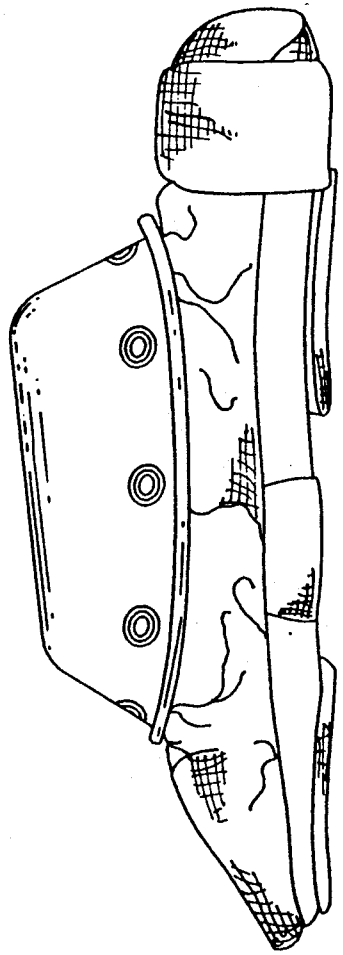
FIG. 4 is a plan view of the shell member.
Figure 3:
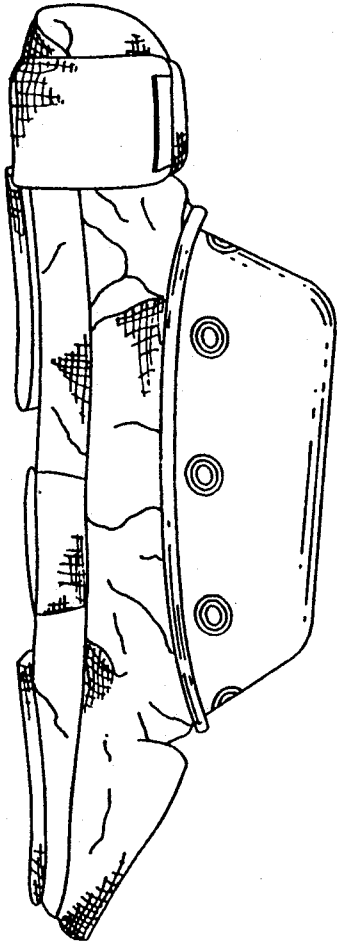
FIG. 3 is an elevational view of the shell member.
Figure 7:
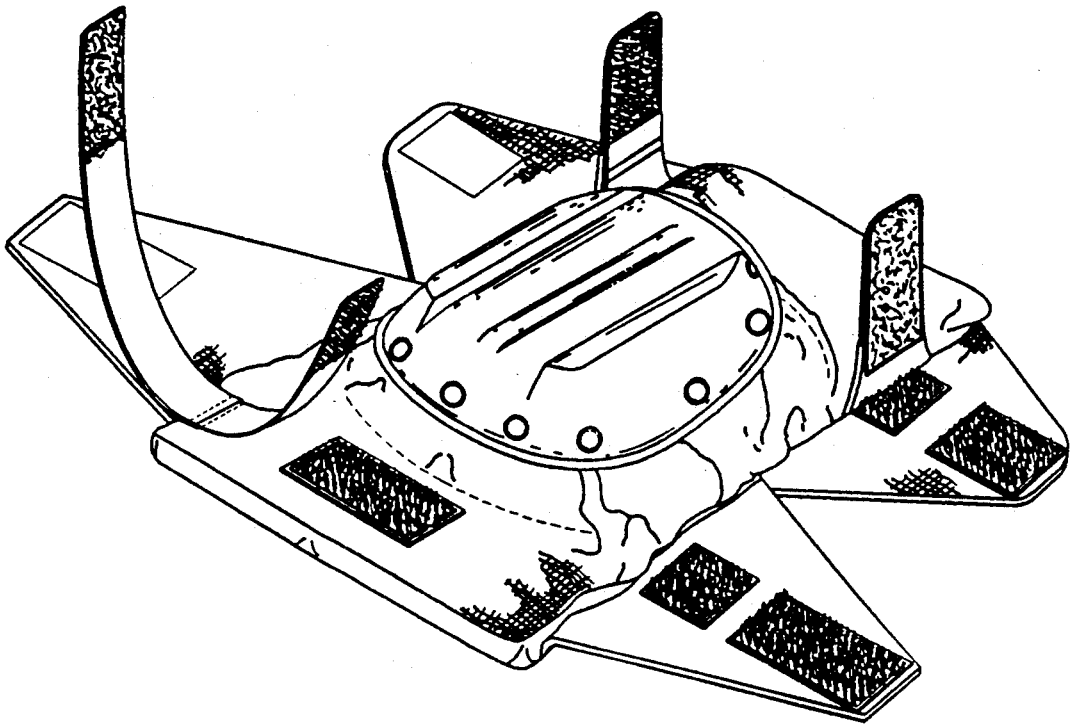
Figure 8:
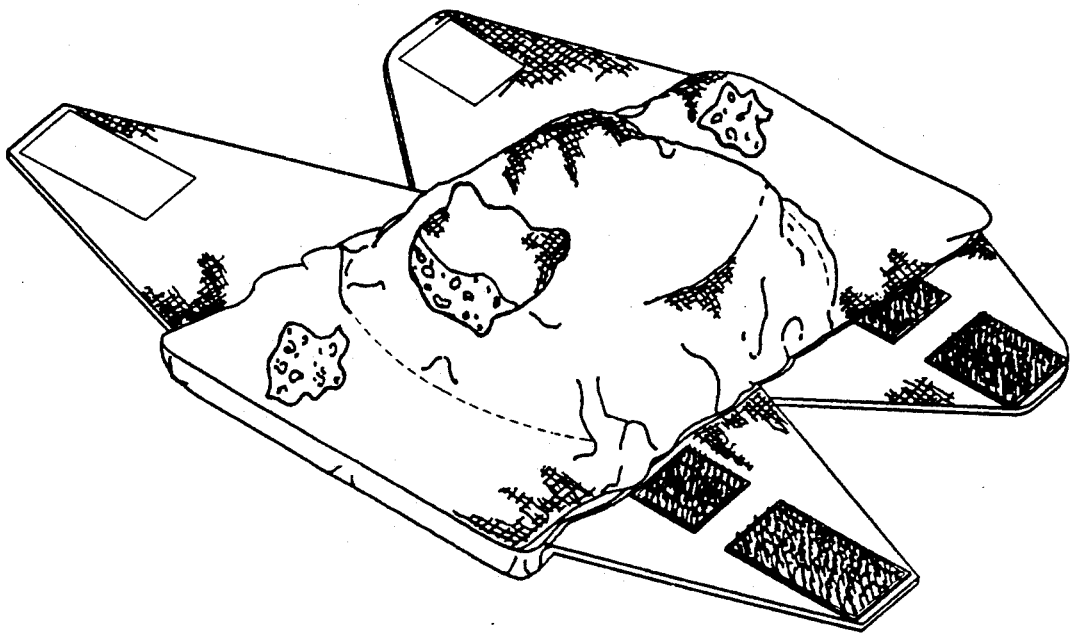
Figure 9:
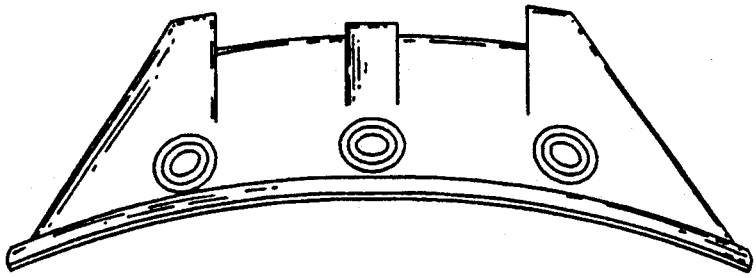
Figure 10:
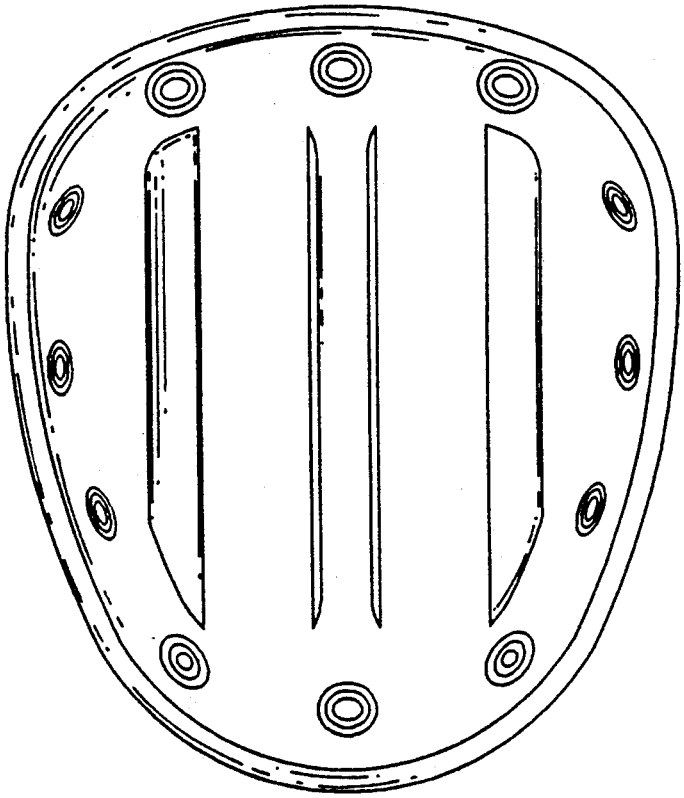

Rigid shell member 12 is defined by convex outer surface 16 having a compound curvature. Integrally molded into convex outer surface 16 are a plurality of raised ridges, which in the preferred embodiment, comprise two opposing side ridges 18 and a central ridge 20. Ridges 18 and 20 extend outward from convex outer surface 12 and blend smoothly therewith. Side ridges 18 have flat sides 22 which intersect the compound curvature of convex outer surface 16 to form a smooth blending of the respective surface and flat sides 24 which both terminate in a top flat portion 26. When viewed in the elevational view depicted in FIG. 3, side ridges 18 define channel 28 therebetween which has central ridge 30 disposed therein midway between each ridge 18. Central ridge 30 protrudes outwardly from convex outer surface 16 and functions as a "hat section" which adds stiffness thereto thereby minimizing any tendency shell 12 may have to buckle under impact loads generated during a rider's fall. Side ridges 18 act as primary stiffeners in the same manner as central ridge 30 but serve an additional function of paramount significance in the invention. Both side ridge 18 flat top portions 26 form a confronting surface oriented on a single plane which may be brought by the rider into sliding contact with the riding surface to assist the rider in executing complex maneuvers. The rider simply orients his knee and the accompanying pad 10 at varying angles of incidence relative to the riding surface such that pad 10 may be employed as a "support" or "braking" aid. Flat top portions 26 will uniformly contact the ground thereby imparting a high degree of stability not possible in a shell configuration having a smooth contoured outer surface. As shown in FIG. 4, the plan view of shell member 12 depicts a shell having four sides which blends smoothly at four corners. Shell 12 may be alternatively fabricated having a more circular profile within the scope of the invention. Shell 12 has a plurality of holes 32 defined in convex outer surface 16 which extend therethrough to provide a means for evacuating air trapped beneath shell 12 when body portion 14 collapses under load which will be discussed in greater detail hereinbelow. Rigid shell member 12 may be fabricated from injection molded or vacuum formed plastic, or by alternative materials and manufacturing methods within the scope of the invention.

Figure 1:
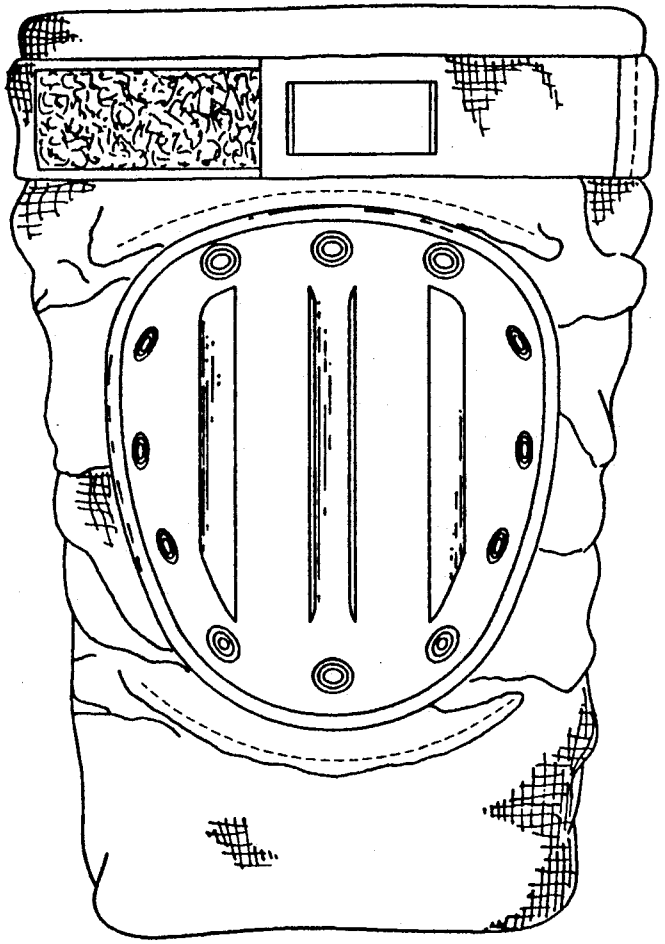
FIG. 1 is a top isometric view of the pad assembly.
Figure 5:
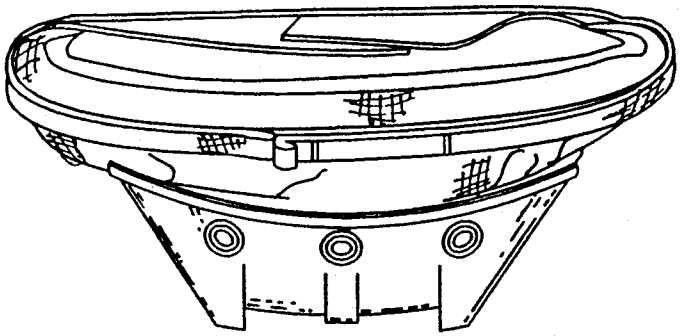
Figure 6:
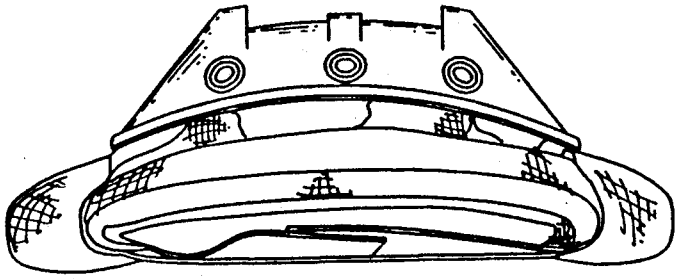

Rigid shell member 12 is secured to body portion 14 by either adhesive or stitching along its periphery. Body portion 14 has first side 34 to which shell 12 is attached, and second side 36 which are joined along a plurality of elongated edges, comprising forward edge 38, rear edge 39, and side edges 41 and 43, by either adhesive or stitching, and which form hollow cavity 40 therebetween. In the preferred embodiment, first side 34 is fabricated from a wearable material such as suede, and second side 36 is constructed from terry cloth. Disposed within hollow cavity 40 is a means for cushioning which may comprise a plurality of elastic members 42 comprising a resilient material such as low density foam. In the preferred embodiment depicted in FIG. 2, body portion 14 has essentially three separate foam insert areas: a first foam insert 44, centrally disposed beneath rigid shell member 12, and second and third foam inserts 46 and 48 respectively, located adjacent first foam insert 44. The foam inserts are rigidly secured within body portion 14 by stitching around each insert as shown in FIGS. 1 and 2 denoted by top stitch lines 48 and 50, bottom stitch lines 52 and 54, and elongated forward and rear edges 38 and 39, and side edges 41 and 43 as previously discussed. Because the foam or its equivalent is elastic, it aids in cushioning and dissipating the impact loads incurred by the rider during a fall which reduces the likelihood of serious knee injuries.

As a means of securing body portion 14 to the rider's leg, there are provided a plurality of neoprene, or constructed from alternative materials, flaps and straps attached to body portion 14. These comprise a pair of forward flaps 56 and 56' disposed along fold lines 58 and 58' near forward edge 38, and a pair of rear flaps 60 and 60' disposed along fold lines 62 and 62' near rear edge 39. Forward flap 56 has hook material 64 disposed on one side which releasably engages loop material 65' on forward flap 56' when the flaps are wrapped around the rider's leg. Similarly, rear flap 60 has hook material 66 disposed on one side which releasably engages loop material 66' on rear flap 60' when the flaps are wrapped around the rider's leg. If desired, an alternative means for releasably securing the overlapping flaps may be substituted within the scope of the invention in lieu of the hook and loop method described. To provide a means of additionally securing body portion 14 to the rider's leg, forward strap 68 and rear strap 70 and 72 respectively are provided. Forward strap 68 is attached to first side 34 near forward edge 38. Strap 68 has hook materials 74 near one end on one side which releasably engage loop material 76 disposed on both sides of strap 68 near its other end. Loop material 76 is also releasably attached to hook material 78 disposed on first side 34. Rear straps 70 and 72 are attached to body portion 14 along fold lines 84 and 86 respectively. Rear straps 70 and 72 have loop material 80 and hook material 82 disposed on opposing faces respectively, whereby they are releasably secured to each other when both are wrapped around the rider's leg.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved knee pad for protecting the knee area of a wearer, comprising:

a rigid shell member having a convex outer surface of compound curvature, said convex outer surface defining a plurality of integrally molded raised ridges, said raised ridges protruding from, and extending outwardly from, said convex outer surface and which blend smoothly therewith, said raised ridges having coplanar upper surfaces for providing a uniform confronting surface for engagement with a riding surface;

a body portion having first and second sides bounded by a plurality of elongated side edges, said first side having means for firmly attaching said shell member thereto; and means for releasably securing said body portion to said wearer's leg, said means for releasably securing connected to said body portion whereby said body portion second side is maintained in contact with said leg such that said shell member and body portion shield said knee area from possible injury and said raised ridge areas of said rigid shell member permit sliding contact with a riding surface to facilitate said wearer's control of a riding device such as a skateboard.

2. The knee pad recited in claim 1, wherein said plurality of raised ridges comprises two opposing side ridges defining a channel therebetween and a central ridge, said side ridges having flat sides disposed on planes intersecting said shell convex outer compound curved surface and a flat top surface intersecting said side surfaces, said central ridge disposed within said channel and extending outwardly from said shell outer surface.

3. The knee pad recited in claim 1, wherein said means for releasably securing comprises:

a plurality of opposing flaps and straps connected to said body portion elongated side edges along fold lines, said flaps and straps having hook and loop patches rigidly attached thereto and disposed on opposing faces on said flaps and straps whereby said hook and loop patches are brought into interfitting releasable engagement when said flaps and straps are wrapped around said leg.

4. The knee pad recited in claim 1, further comprising means for cushioning impact loads between said rigid shell and said knee area, said means for cushioning disposed within said body portion between said first and second sides and along said elongated side edges.

5. The knee pad recited in claim 4, wherein said means for cushioning comprises a first foam inserts adapted to fit within said rigid shell member, and second and third foam insert disposed adjacent to said first foam insert.

6. The knee pad recited in claim 1, wherein said body portion first side is fabricated from suede.

7. The knee pad recited in claim 1, wherein said body portion second side is fabricated from terry cloth.

8. An improved knee pad for protecting the knee area of a wearer, comprising:

a rigid shell member having a convex outer surface of compound curvature, said convex outer surface defining a plurality of integrally molded raised ridges, said raised ridges protruding from, and extending outwardly from, said convex outer surface and which blend smoothly therewith, said raised ridges comprising two opposing side ridges defining a channel therebetween and a central ridge, said side ridges having flat sides disposed on planes intersecting said shell convex outer compound curved surface and a flat top surface intersecting said side surfaces, said flat top surface providing a uniform confronting surface for engagement with a riding surface, said central ridge disposed within said channel;

a body portion having first and second sides bounded by a plurality of elongated side edges, said first side having means for firmly attaching said shell member thereto, said body portion further comprising means for cushioning impact loads between said rigid shell and said knee area, said means for cushioning disposed within said body portion between said first and second sides and along said elongated side edges, said means for cushioning comprising a first foam insert adapted to fit within said rigid shell member, and second and third foam inserts disposed adjacent to said first foam insert;

means for releasably securing said body portion to said wearer's leg, said means for releasably securing comprising a plurality of opposing flaps and straps connected to said body portion side edges along fold lines, said flaps and straps having hook and loop patches rigidly attached thereto and disposed on opposing faces of said flaps and straps whereby said hook and loop patches are brought into interfitting releasable engagement when said flaps and straps are wrapped around said leg, whereby said body portion second side is maintained in contact with said leg such that said shell member and body portion shield said knee area from possible injury and said raised ridge areas of said rigid shell permit sliding contact with the ground to facilitate said wearer's control of a riding device such as a skateboard.

9. The knee pad recited in claim 8, wherein said first side is fabricated from suede.

10. The knee pad recited in claim 8, wherein said second side is fabricated from terry cloth.

* * * * *